United States Patent [19]

Borgstrom et al.

[11] Patent Number: 4,773,872

[45] Date of Patent: Sep. 27, 1988

[54] STATIC CONTACT MEMBER FOR A HIGH-VOLTAGE BUSHING INSERT

[75] Inventors: Alan D. Borgstrom, Hackettstown; Frank M. Stepniak, Long Valley, both of N.J.

[73] Assignee: Amerace Corporation, Parsippany, N.J.

[21] Appl. No.: 48,576

[22] Filed: May 11, 1987

[51] Int. Cl.[4] ..... H01R 13/53

[52] U.S. Cl. ..... 439/185; 439/187; 439/921

[58] Field of Search ..... 439/284, 289, 293, 476, 439/482, 483, 816, 819, 820, 824, 837, 839, 840, 88, 89, 181, 183–187, 477, 479, 480, 483, 484, 821, 825, 921

[56] References Cited

U.S. PATENT DOCUMENTS

| | | | |
|---|---|---|---|
| 4,119,358 | 10/1978 | Tachick et al. | 439/185 |
| 4,131,329 | 12/1978 | Flatt | 439/185 |
| 4,186,985 | 2/1980 | Stepniak et al. | 439/185 |
| 4,464,004 | 8/1984 | Hegyi et al. | 439/182 |

*Primary Examiner*—David Pirlot
*Attorney, Agent, or Firm*—David Teschner

[57] ABSTRACT

In a high-voltage bushing insert having a moving, piston-operated, female contact assembly electrically coupled to an interior metallic sleeve by means of a louvered contact ring, the improvement comprising a static metallic contact member providing an alternative electrical path from said female contact assembly to said metallic sleeve. The static contact member is generally circular and substantially closed at a first end and is multiply slotted adjacent its second end to provide a series of bulbous, spring fingers thereat. The spring fingers making intimate electrical contact with the interior of the female contact assembly in its static position and for a portion of its travel away from the closed end of the metallic sleeve. An exterior ring at the contact's first end assures good electrical contact with the metallic sleeve. The contact bore base can be formed with a wrench flat driving arrangement, or unthreaded to accept a threaded stud used to couple the insert to the bushing well threaded aperture or threaded to accept the threaded stud of a bushing well.

9 Claims, 8 Drawing Sheets

100'

200

STATIC CONTACT MEMBER FOR A HIGH-VOLTAGE BUSHING INSERT

BACKGROUND OF THE INVENTION

1. Field of the Invention

The invention relates to high-voltage separable connectors and more particularly to load-break bushing inserts with piston-operated movable female contact assemblies propelled by the production of arc-quenching gases within such inserts.

2. Description of the Prior Art:

High-voltage separable connectors are intended to interconnect sources of energy such as transformers to distribution networks or the like. A typical arrangement includes a bushing well connected to the transformer, a bushing insert which contains a female contact assembly connected to the well and an elbow connected to a distribution line and containing the male contact to join the insert contact. Because closure of the male and female contacts can occur under activated conditions or under fault conditions, the female contact is arranged to move within the insert to hasten the closure of the male and female contacts and thus extinguish any arc created. However, it is necessary to maintain electrical continuity during the travel of the female contact. The connection between such female contact and the remainder of the bushing insert must be flexible so as not to impede its movement but sufficient to carry the high currents in the circuit. Mechanisms for achieving these results have not always provided sufficient current paths for the static condition of the bushing insert causing same to run hot and interfering with proper operation of the distribution network and in the extreme leading to the destruction of the bushing inserts.

In U.S. Pat. No. 3,982,812, issued Sept. 28, 1976 to General Electric Company, FIG. 1 of which appears as FIG. 1 in this Application, bushing insert or module 1 contains a metal cylinder 8 in which movable female contact 4 moves from a rest position to engage an inserted metal contact rod 10. Contact between the female contact 4 and the cylinder 8 during movement is maintained by flexible coiled conductor 5. Because of the need for flexibility and the space constraints inside the bushing insert or module 1, the size of the conductor 5 is not optimum for static current transfer.

In U.S. Pat. No. 4,186,985 issued Feb. 5, 1980, FIGS. 1 and 2 of which appear as FIGS. 2 and 3 herein, and U.S. Pat. No. 3,930,709 issued Jan. 6, 1976, FIG. 4 of which appears herein as FIG. 4, both patents being assigned to the assignee of the instant Application, there is shown a louvered contact ring or spring 34, 52. As is shown in FIG. 2, metallic sleeve 12 is electrically coupled to female contact assembly 30 by means of louvered spring 34 which encircles and is movable with piston 32 of the assembly 30. FIG. 4 shows that actual contact is achieved by the ends of the spring fingers **52*b* and 52*c* which respectively contact metallic sleeve 38 and the piston 50**.

The quality and resistance of such contact is dependent upon the number of finger ends in contact and the amount of surface in contact. Distortion of the fingers, the presence of dirt or contaminants all decrease the amount of available contact area and influence the current density. Electrical contact during female contact movement may be adequate but static current transfer may not be.

SUMMARY OF THE INVENTION

The instant invention overcomes the difficulties noted above with respect to the prior art devices mentioned by providing an additional contact member functional when the female contact assembly is at rest or at the beginning of its travel to provide a good electrical contact between the female contact assembly and the metallic sleeve of the bushing insert. During the remainder of the female contact assembly travel, the conventional techniques, such as the louvered contact, provide sufficient contact and current transfer.

The additional contact member is a static metallic cylinder substantially closed at one end in one form, with a wrenching configuration; with a bore to receive an assembly fastener in another and with a threaded bore, in yet another form, to receive the threaded stud of a bushing well.

About the outer surface of the closed end is a knurled annular ring to assist in anchoring the static contact to the closed end of the metallic sleeve. The opposite end of the cylinder is slotted to form a series of independent contact fingers. The outer surface of the cylinder adjacent the spring finger ends is enlarged to form a bulbous contact surface for maximum contact and current transfer with minimum heat loss. It is an object of this invention to provide a static electrical contact for a moving female contact assembly.

It is an object of this invention to provide an alternative, static contact to the movable contacts normally found in connectors having movable female contacts.

It is another object of this invention to provide a low resistance, high current transfer contact for a movable female contact assembly when said assembly is static and during its initial travel distance.

It is yet another object of this invention to provide a static, low-resistance, high current transfer contact for the movable female contact assembly of a high-voltage connector component having a further contact for such female contact assembly during movement thereof.

Other objects and features of the invention will be pointed out in the following description and claims and illustrated in the accompanying drawings, which disclose, by way of example, the principles of the invention, and the best modes which have been contemplated for carrying them out.

BRIEF DESCRIPTION OF THE DRAWING

In the drawings in which similar elements are given similar reference characters.

DESCRIPTION OF THE PREFERRED EMBODIMENTS

Figure 1:
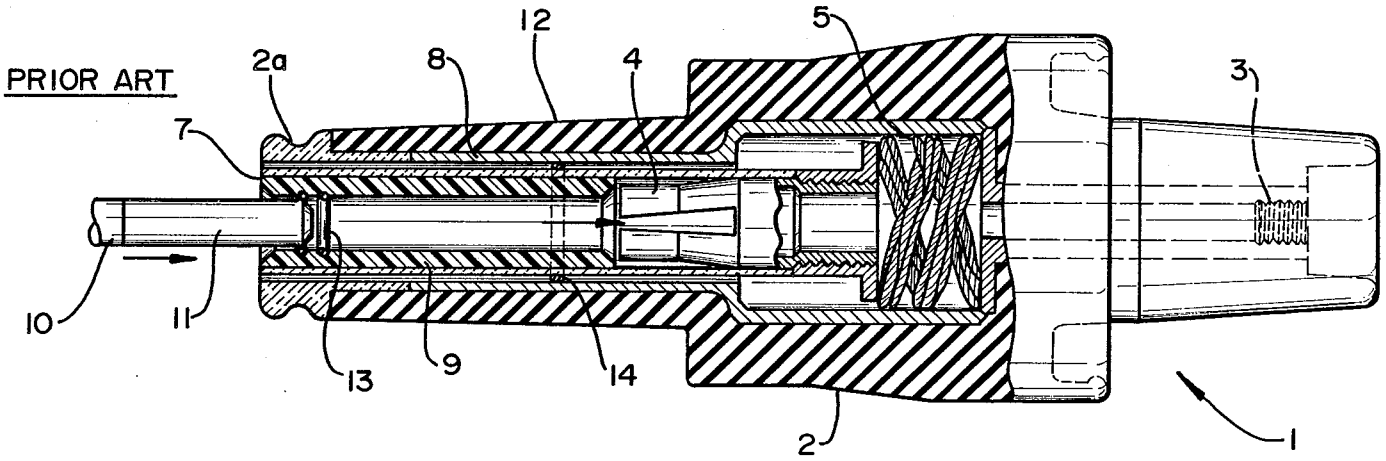
FIG-1 PRIOR ART
FIG. 1 is a side elevation, partly in section, of a prior art bushing insert and is FIG. 1 of U.S. Pat. No. 3,982,812 isued Sept. 28, 1976.
Figure 2:
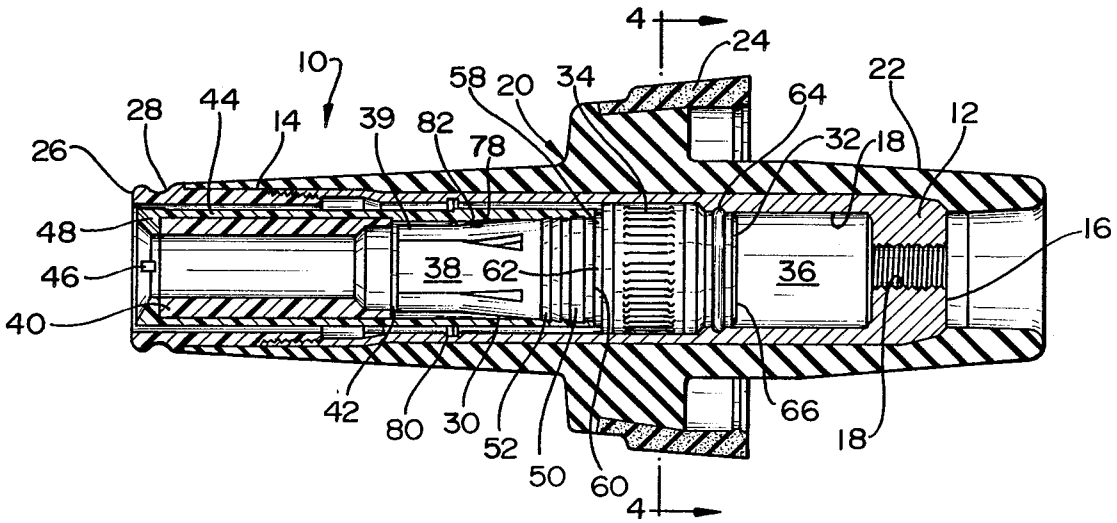
FIG-2 PRIOR ART
FIGS. 2 and 3 are side elevations, in section, of a prior-art bushing insert and are FIGS. 1 and 2 of U.S. Pat. No. 4,086,985 issued Jan. 6, 1976.
Figure 3:
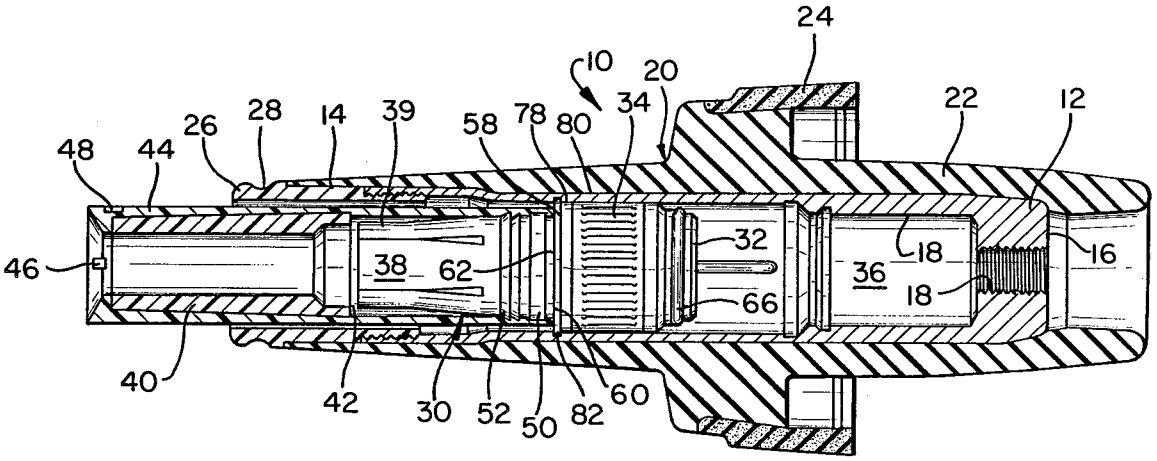
FIG-3 PRIOR ART
Figure 5:
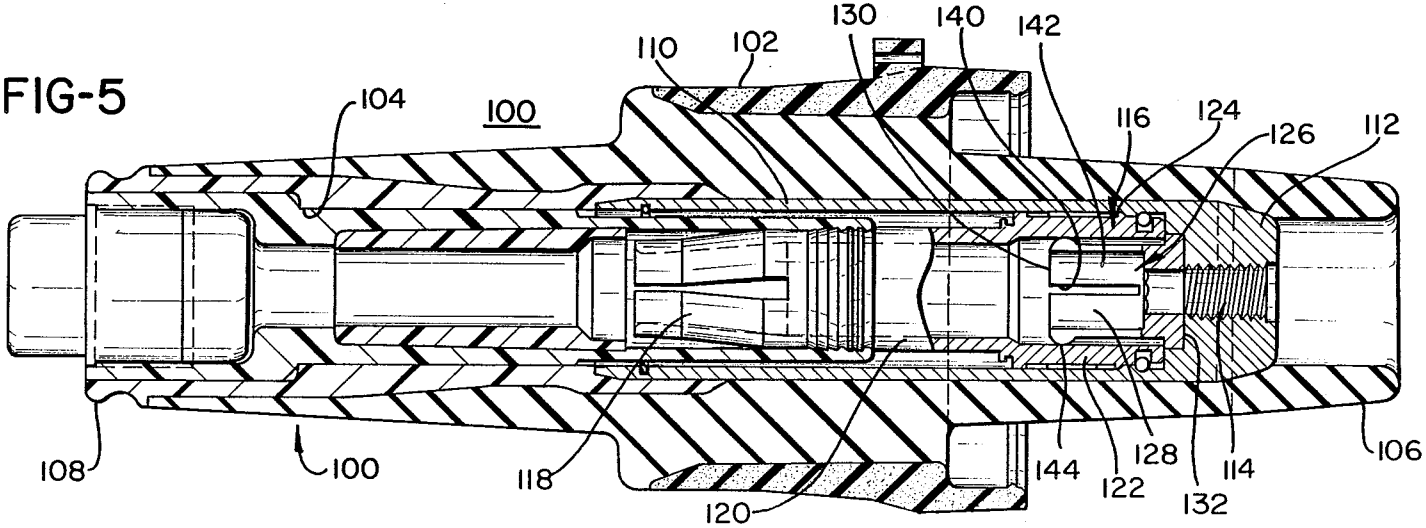
FIG. 5 is a side elevation, in section, of a bushing insert constructed in accordance with the concepts of the invention.
Figure 4:
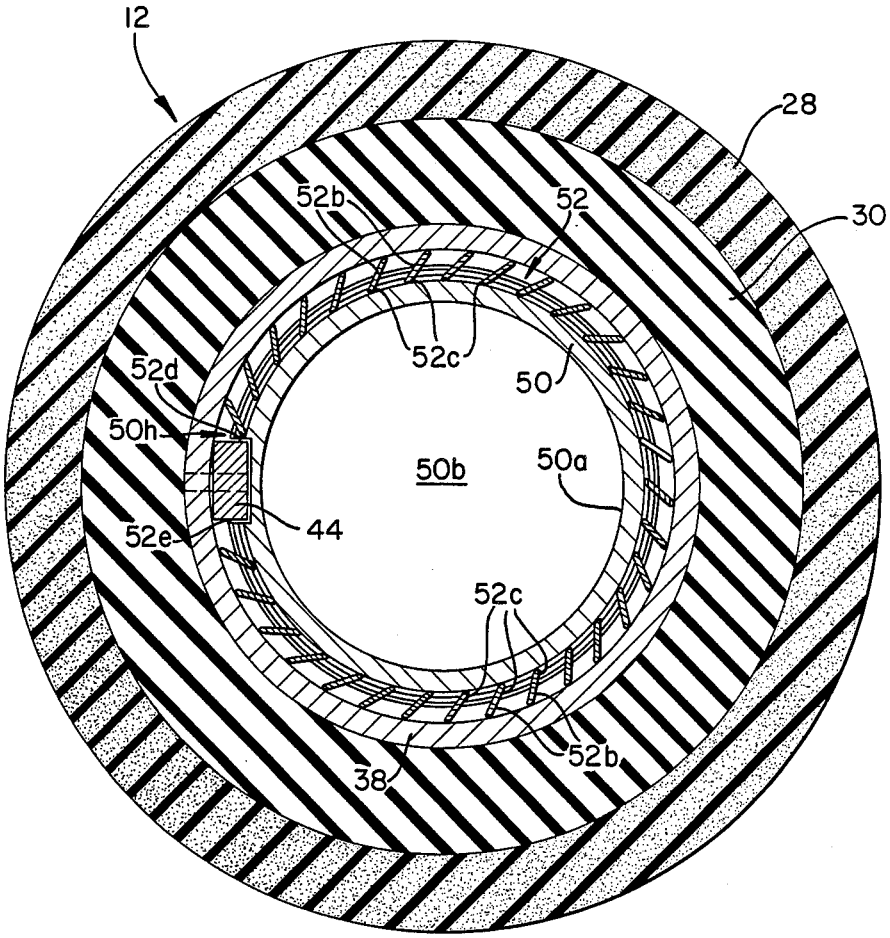
FIG-4 PRIOR ART
FIG. 4 is a front elevation, in section, of the bushing insert of FIG. 2 taken along the line 4—4 therein and is FIG. 4 of U.S. Pat. No. 3,930,709 issued January 6, 1976.
Figure 6:
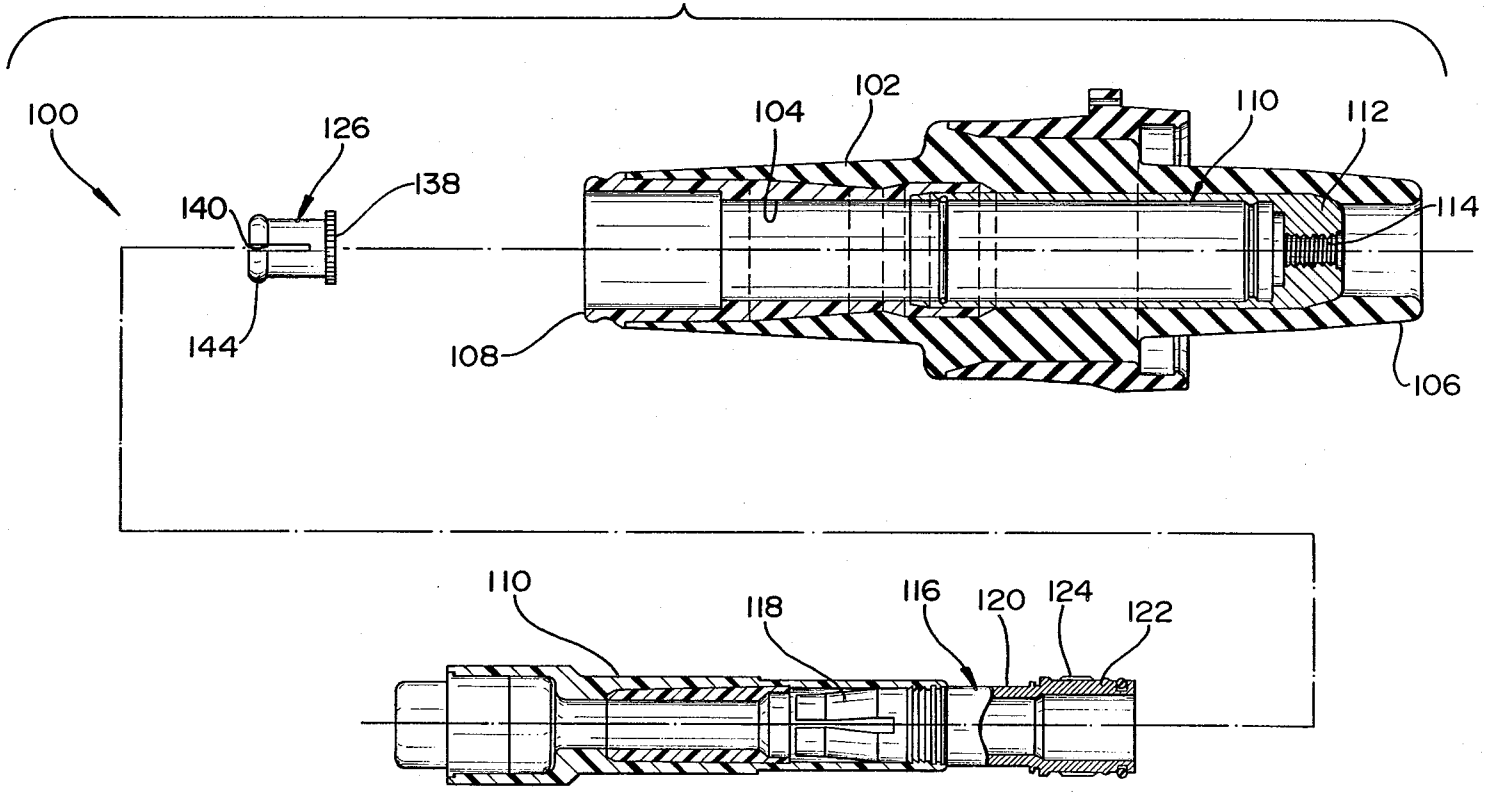
FIG. 6 is the bushing insert of FIG. 5 exploded so that the main subassemblies can be better appreciated.
Figure 7:
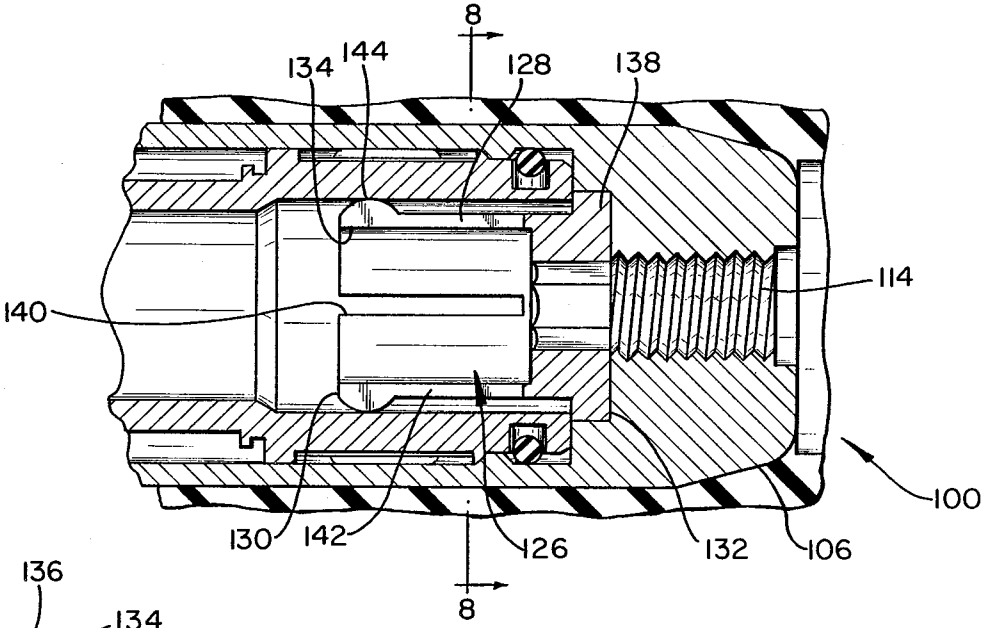
FIG. 7 is an enlargement of a portion of the bushing insert of FIG. 5 so that the details thereof are more readily viewed.
Figure 8:
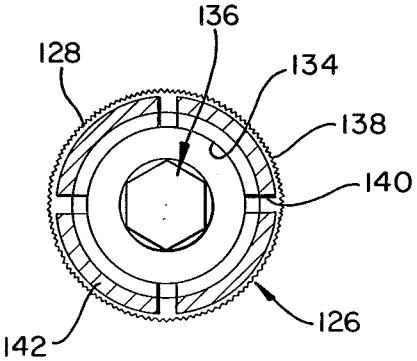
FIG. 8 is a front elevation of the static contact member of FIG. 5, partly in section and taken along the line 8—8 in FIG. 7.

Turning now to FIGS. 5 to 8, there is shown a first embodiment of a bushing insert 100 constructed in accordance with the concepts of the invention. Bushing insert 100 is composed of an elongated body portion 102 fabricated from an insulating material such as rubber, synthetic rubber, plastic or the like and may be EDPM rubber. A longitudinal bore 104 extends the entire length of the body portion 102 from a first end 106 to a second end 108. Fitted within bore 104, from approximately the mid-point of body portion 102 between respective ends 106, 108 toward first end 106 is a generally hollow, cylindrical metal sleeve 110 having a substantially closed end 112 adjacent body portion 102 first end 106. A threaded aperture 114 extends in the approximate center of closed end 112 to receive the threaded stud (not shown) of a bushing well to permit the bushing insert 100 to be electrically and mechanically coupled to such bushing well.

Positioned within and arranged to move relative to said metal sleeve 110 is a female contact assembly 116 composed of the female contacts 118, a metallic tubular support 120 and a piston 122. As is well known in the art when connector parts are closed under activated conditions, an arc is formed which causes the generation of arc-quenching gases within the bushing insert which operate on the piston 122 of the female contact assembly 116 to cause same to be moved toward end 108 of body portion 102 hastening the solid connection of female contacts 118 with the male contact (not shown) to eliminate the arc. During movement of the female contact assembly 116, electrical contact between the female contact assembly 116 and the metallic sleeve 110 is maintained by means of a louvered, spring contact ring 124 of the type shown in the U.S. Pats. 4,186,985 and 3,930,709. It should be understood that although a louvered, spring contact ring is shown and described herein, it is merely representative of any type of flexible or sliding connection between the metallic sleeve and the female contact assembly.

As stated above, the quality of the contact will depend upon the shape of the contact fingers, the amount of actual surface of the contact fingers in contact with the metallic sleeve 110 and piston 122 and the presence of any moisture, dirt or other contaminants on those surfaces. Although adequate for moving contact, the resilient fingers of contact ring 124 generally do not make sufficient contact to provide a low current density, solid electrical contact for the bushing insert when in its most usual at rest condition, that is, with the female contact assembly 116 in the position shown in FIG. 5.

To provide the desired at rest, solid electrical contact with high current transfer at low current density with low heating, the instant invention adds static contact member 126. Static contact member 126 has a generally cylindrical body 128 having a bore 134 opening from a first end 130 and extending toward second end 132. Formed at the base of bore 134 is a hexagonal wrenching configuration 136 (see FIG. 8) to permit the entire bushing insert 100 to be turned onto the threaded stud of a bushing well by means of an appropriate wrench (not shown) applied to such wrenching configuration 136. Adjacent end 132 is a knurled annular ring 138 used to anchor the contact 126 into the metal of the closed end 112 of metal sleeve 110 to prevent its displacement with contact assembly 116 and its rotation within sleeve 110.

Extending inwardly from first end 130 toward second end 132 are a series of slots 140 which divide the contact 126 adjacent end 130 into a series of segments or spring fingers 142. The outer surface of contact 126 is built up in the region of first end 130 to give the individual spring fingers 142 a bulbous outline such as 144 and assuring a good electrical contact with the inner surface of the female contact assembly 116 at its rest position adjacent first end 106 of the body portion 102 and for a portion of the travel of the female contact assembly 116 toward second end 108. During this period, there is thus a dual electrical path between the female contact assembly 116 and the metallic sleeve 110. A first path extends through louvered spring contact 124 and the second, alternative contact path through static contact member 126.

Figure 9:
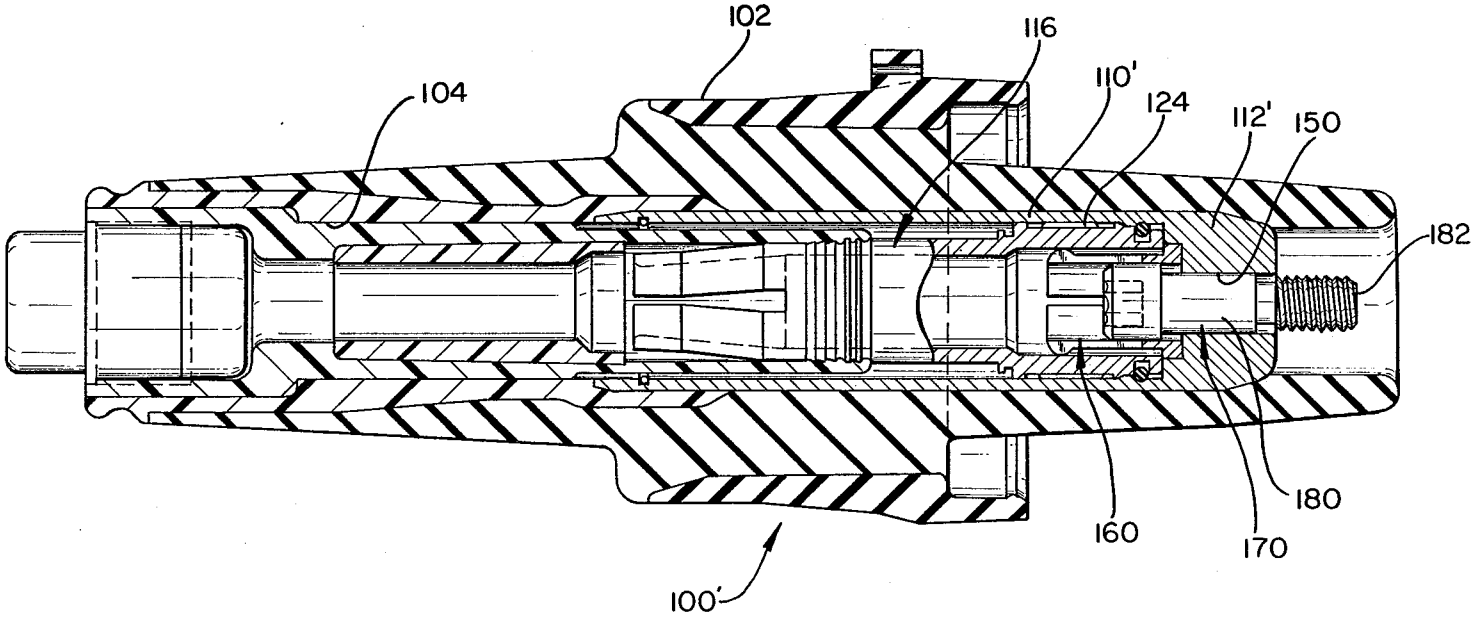
FIG. 9 is a side elevation, in section, of a further embodiment of a bushing insert constructed in accordance with the concepts of the invention.
Figure 10:
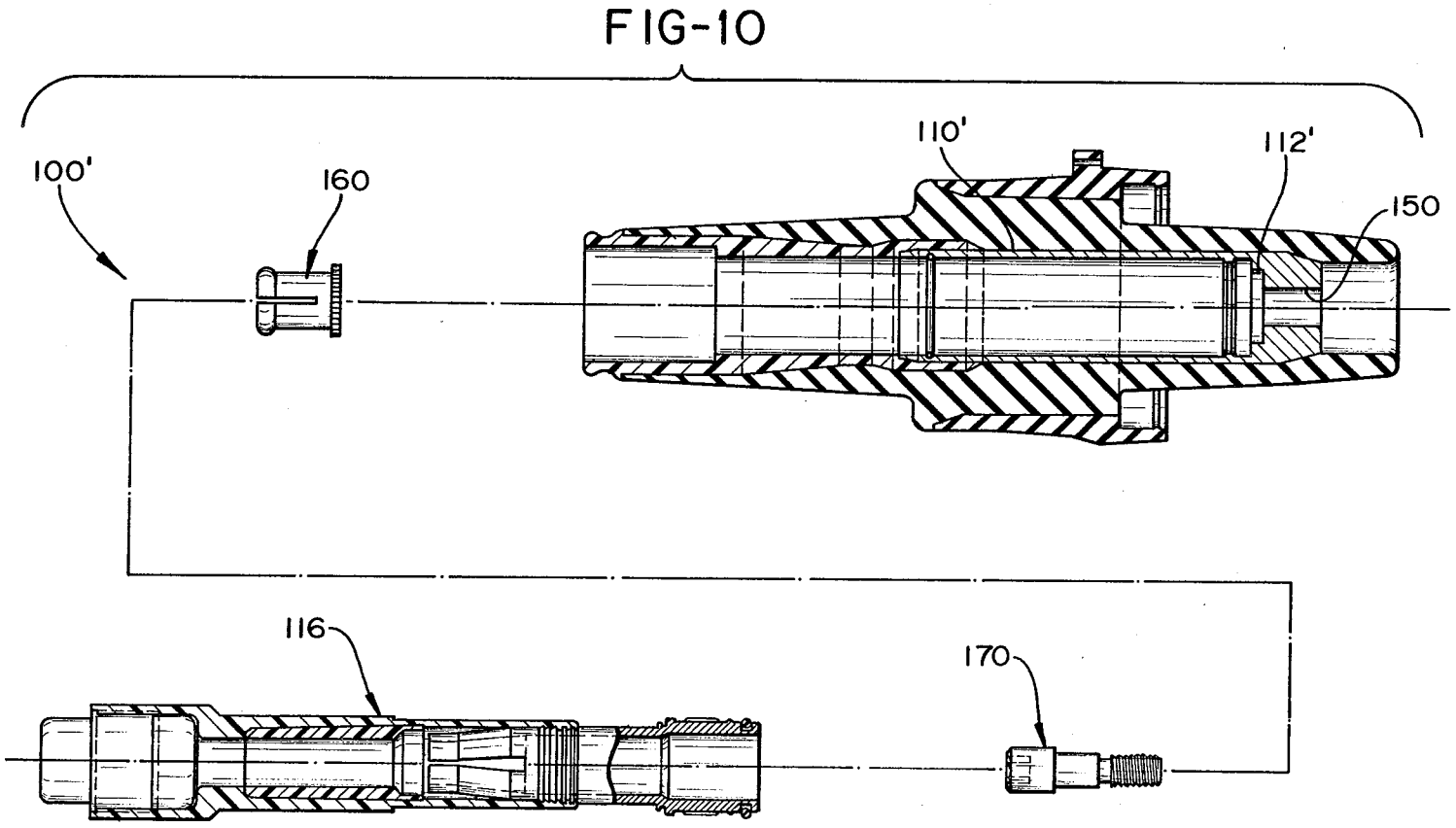
FIG. 10 is the bushing insert of FIG. 8 exploded so that the main subassemblies can be better appreciated.
Figure 11:
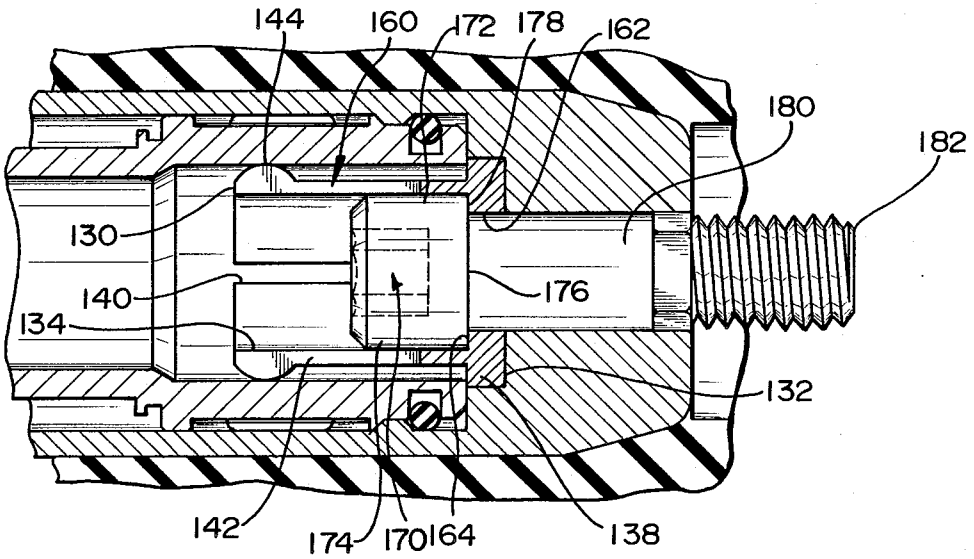
FIG. 11 is an enlargement of a portion of the bushing insert of FIG. 8 so that the details thereof are more readily viewed.

An alternative construction is shown for static contact member 160 in FIGS. 9, 10 and 11. In this configuration, it is desired that the entire bushing insert 100' not be rotated to unite it with a bushing well. Instead, a threaded stud 170 is passed through the aperture 150 in a modified end portion 112' of metallic sleeve 110' and engaged with a complementary threaded recess in a bushing well (not shown).

Static contact member 160 is generally the same as member 126 having a generally cylindrical configuration with a knurled annular ring 138 adjacent second end 132 and a series of slots 140 adjacent first end 130 to divide that end into a series of spring fingers 142 and having a built up outer surface to give the spring fingers 142 the desired bulbous configuration 144. A central bore 134 extends for a portion of its length and communicates with a second, smaller diameter bore 162 which extends to end 132 within ring 138. The interface between bores 134 and 162 results in a shoulder 164.

A threaded stud 170 having a head portion 172 with wrench flats 174 thereon is used to assemble bushing insert 100' to a bushing well as set out above. A shank 180 extends from the underside 176 of head portion 172 and is of a diameter less than that of head portion 172 providing a shoulder 178. The end of shank 180 is externally threaded as at 182 to engage a bushing well (not shown).

Static contact member 160 is attached by a press fit into closed end 112' of metallic sleeve 110'. Stud 170 is now inserted through bores 134 and 162 of member 160 and aperture 150 of end 112' of metallic sleeve 110' for attachment to the bushing well (not shown). The engagement of shoulder 178 of threaded stud 170 with shoulder 164 of contact member 160 provides good mechanical and electrical coupling. The same alternative electrical paths exist for this configuration as with that of FIGS. 5 to 8 as set out above.

Figure 12:
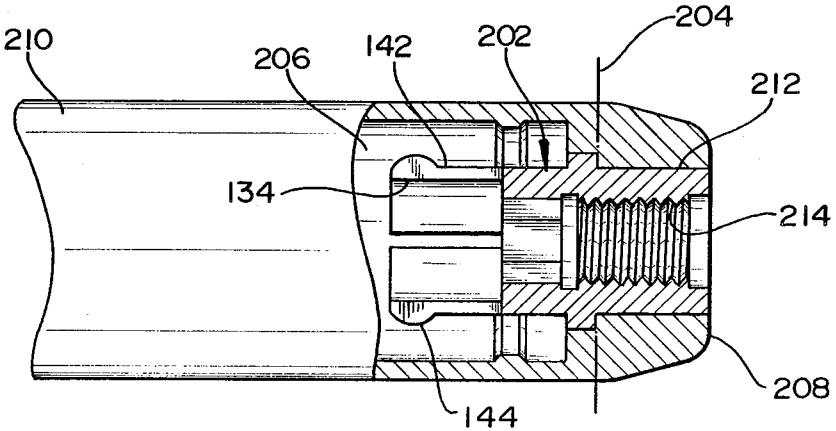
FIG. 12 is a fragmentary side elevation, in section, of yet a further bushing insert constructed in accordance with the concepts of the invention.

FIG. 12 shows a further form of bushing insert 200 where the static contact member 202 forms the closed end of the metallic sleeve 206 adjacent first end 208 of the elongated body portion 210. The member 202 to the left of line 204 in the drawing is the same as contact member 126 of FIGS. 5 to 8 and includes spring fingers 142 with bulbous portion 144 and bore 134 terminating in wrenching configuration 136. To the right of the line 204 the contact member 202 continues as a cylindrical portion 212 extending to the very end 208 of body portion 210. A bore 214 extends within the length of cylindrical portion 212 and into the region of annular ring 138. The threaded stud (not shown) of the bushing well can thus be screwed directly into static contact member 202 thus reducing any resistance and improving the electrical contact between the bushing well and metallic sleeve 206 of bushing insert 200. The knurled edge of annular ring 138 again serves to anchor contact 202 and prevent its removal or rotation.

While there have been shown and described and pointed out the fundamental novel features of the invention as applied to the preferred embodiments, it will be understood that various omissions and substitutions and changes of the form and details of the devices illustrated and in their operation may be made by those skilled in the art without departing from the spirit of the invention.

The embodiments of the invention in which an exclusive property or privilege is claimed are defined as follows:

1. In a high-voltage load-break bushing insert of the type having an elongate, insulative body member with a central bore extending from a first end to a second end; a generally hollow, cylindrical metallic sleeve within a portion of said body member, said metallic sleeve having a substantially closed end adjacent said first end of said body member; said metallic sleeve adapted to be electrically coupled to a bushing well; a movable female contact assembly positioned within the hollow portion of said metallic sleeve for non-engaging movement therein from adjacent said first end of said body member toward said second end of said body member; a flexible or sliding connection for making electrical contact between said female contact assembly and said metallic sleeve to provide a continuous electrical path therebetween; the improvement comprising:

a static contact member in intimate contact with said female contact assembly when said assembly is positioned adjacent said closed end and for a short distance after said female contact assembly begins to move toward said second end of said body member to provide an alternative electrical path from said assembly to said sleeve; said static contact member having a generally circular configuration and segmented so as to provide a series of spring fingers arranged to engage said movable female contact assembly.

2. In a high-voltage load-break bushing insert of the type having an elongate, insulative body member with a central bore extending from a first end to a second end; a generally hollow, cylindrical metallic sleeve within a portion of said body member, said metallic sleeve having a substantially closed end adjacent said first end of said body member; said metallic sleeve adapted to be electrically coupled to a bushing well; a movable female contact assembly positioned within the hollow portion of said metallic sleeve for non-engaging movement therein from adjacent said first end of said body member toward said second end of said body member; a flexible or sliding connection for making electrical contact between said female contact assembly and said metallic sleeve to provide a continuous electrical path therebetween; the improvement comprising:

a static contact member in intimate contact with said female contact assembly when said assembly is positioned adjacent said closed end and for a short distance after said female contact assembly begins to move toward said second end of said body member to provide an alternative electrical path from said assembly to said sleeve; said static contact member being generally cylindrical and extending from a first end to a second end, an annular ring about said contact member adjacent a first end thereof; a series of slots extending from said second end toward said first end of said contact member defining therebetween a series of fingers each with a bulbous portion at said second end to provide intimate contact with the interior surface of said movable female contact assembly.

3. In a high-voltage load-break bushing insert of the type having an elongate, insulative body member with a central bore extending from a first end to a second end; a generally hollow, cylindrical metallic sleeve within a portion of said body member, said metallic sleeve having a substantially closed end adjacent said first end of said body member; said metallic sleeve adapted to be electrically coupled to a bushing well; a movable female contact assembly positioned within the hollow portion of said metallic sleeve for non-engaging movement therein from adjacent said first end of said body member toward said second end of said body member; a flexible or sliding connection for making electrical contact between said female contact assembly and said metallic sleeve to provide a continuous electrical path therebetween; the improvement comprising:

a static contact member in intimate contact with said female contact assembly when said assembly is positioned adjacent said closed end and for a short distance after said female contact assembly begins to move toward said second end of said body member to provide an alternative electrical path from said assembly to said sleeve; said static contact member having a generally circular configuration and having an annular ring about the outer surface thereof adjacent a first end of said contact member for engageable contact with said closed end of said sleeve member.

4. In a high-voltage load-break bushing insert of the type having an elongate, insulative body member with a central bore extending from a first end to a second end; a generally hollow, cylindrical metallic sleeve within a portion of said body member, said metallic sleeve having a substantially closed end adjacent said first end of said body member; said metallic sleeve adapted to be electrically coupled to a bushing well; a movable female contact assembly positioned within the hollow portion of said metallic sleeve for non-engaging movement therein from adjacent said first end of said body member toward said second end of said body member; a flexible or sliding connection for making electrical contact between said female contact assembly and said metallic sleeve to provide a continuous electrical path therebetween; the improvement comprising:

a static contact member in intimate contact with said female contact assembly when said assembly is positioned adjacent said closed end and for a short distance after said female contact assembly begins to move toward said second end of said body member to provide an alternative electrical path from said assembly to said sleeve; said static contact member having a generally circular configuration and having a first end and a second end; said static contact member having a generally closed portion adjacent said first end for engagement with the closed end of said metallic sleeve to provide a good electrical contact between said contact member and said metallic sleeve.

5. The high-voltage load-break bushing insert as defined in claim 4, having a bore through said closed portion of said contact member and said closed end of said metallic sleeve; and a headed, threaded stud extending through said bore into a complementary threaded recess in said bushing well, said head engaging said closed portion of said contact member to prevent its being drawn through said bore.

6. In a high-voltage load-break bushing insert of the type having an elongate, insulative body member with a central bore extending from a first end to a second end; a generally hollow, cylindrical metallic sleeve within a portion of said body member, said metallic sleeve having a substantially closed end adjacent said first end of said body member; said metallic sleeve adapted to be electrically coupled to a bushing well; a movable female contact assembly positioned within the hollow portion of said metallic sleeve for non-engaging movement therein from adjacent said first end of said body member toward said second end of said body member; a flexible or sliding connection for making electrical contact between said female contact assembly and said metallic sleeve to provide a continuous electrical path therebetween; the improvement comprising:

a static contact member in intimate contact with said female contact assembly when said assembly is positioned adjacent said closed end and for a short distance after said female contact assembly begins to move toward said second end of said body member to provide an alternative electrical path from said assembly to said sleeve; said static contact member having a generally circular configuration and a bore extending for a portion of its length and the closed end of said bore is formed with a series of wrench flats whereby said contact member can be rotated by means of a tool applied to said wrench flats.

7. In a high-voltage load-break bushing insert of the type having an elongate, insulative body member with a central bore extending from a first end to a second end; a generally hollow, cylindrical metallic sleeve within a portion of said body member, said metallic sleeve having a substantially closed end adjacent said first end of said body member; said metallic sleeve adapted to be electrically coupled to a bushing well; a movable female contact assembly positioned within the hollow portion of said metallic sleeve for non-engaging movement therein from adjacent said first end of said body member toward said second end of said body member; a flexible or sliding connection for making electrical contact between said female contact assembly and said metallic sleeve to provide a continuous electrical path therebetween; the improvement comprising:

a static contact member in intimate contact with said female contact assembly when said assembly is positioned adjacent said closed end and for a short distance after said female contact assembly begins to move toward said second end of said body member to provide an alternative electrical path from said assembly to said sleeve; said contact member forms the closed end of said metallic sleeve and further includes an internally threaded bore opening into said body member first end to receive the threaded stud of a mating bushing well.

8. The high-voltage load-break bushing insert as defined in claim 7, wherein said static contact member has a generally cylindrical configuration.

9. The high-voltage load-break bushing insert as defined in claim 8, wherein said static contact member has a first portion defined by a series of segments comprising spring fingers and a second portion having a longitudinal threaded bore therein to receive the threaded stud of a mating bushing well.

* * * * *

UNITED STATES PATENT AND TRADEMARK OFFICE

CERTIFICATE OF CORRECTION

PATENT NO. : 4,773,872

DATED : September 27, 1988

INVENTOR(S) : Alan D. Borgstrom and Frank M. Stepniak

It is certified that error appears in the above—identified patent and that said Letters Patent is hereby corrected as shown below:

In the Specification:

Col. 2, line 54, change "isued" to --issued--.
line 57, change "4,086,985 issued Jan. 6, 1976" to
-- 4,186,985 issued Feb. 5, 1980.-

Signed and Sealed this

Third Day of July, 1990

*Attest:*

*Attesting Officer*

HARRY F. MANBECK, JR.

*Commissioner of Patents and Trademarks*